US011501905B2

(12) United States Patent
Guo et al.

(10) Patent No.: US 11,501,905 B2
(45) Date of Patent: Nov. 15, 2022

(54) COMPOSITION AND METHOD OF MAKING A MONOLITHIC HETEROSTRUCTURE OF MULTIFERROIC THIN FILMS

(71) Applicant: Boston Applied Technologies, Inc., Woburn, MA (US)

(72) Inventors: Xiaomei Guo, West Roxbury, MA (US); Kewen Kevin Li, Andover, MA (US); Yingyin Kevin Zou, Lexington, MA (US); Hua Jiang, Sharon, MA (US)

(73) Assignee: BOSTON APPLIED TECHNOLOGIES, INC., Woburn, MA (US)

( * ) Notice: Subject to any disclaimer, the term of this patent is extended or adjusted under 35 U.S.C. 154(b) by 20 days.

(21) Appl. No.: 17/007,321

(22) Filed: Aug. 31, 2020

(65) Prior Publication Data

US 2022/0068536 A1 Mar. 3, 2022

(51) Int. Cl.

| | |
|---|---|
| ***H01F 10/20*** | (2006.01) |
| ***H01F 10/26*** | (2006.01) |
| ***H01F 10/28*** | (2006.01) |
| ***H01F 10/30*** | (2006.01) |
| ***H01F 41/24*** | (2006.01) |

(52) U.S. Cl.

CPC ..... *H01F 10/205* (2013.01); *H01F 10/265* (2013.01); *H01F 10/28* (2013.01); *H01F 10/30* (2013.01); *H01F 41/24* (2013.01)

(58) Field of Classification Search

None

See application file for complete search history.

(56) References Cited

U.S. PATENT DOCUMENTS

| | | | | | |
|---|---|---|---|---|---|
| 5,168,420 | A * | 12/1992 | Ramesh | H01L 28/55 | 505/192 |
| 5,519,235 | A * | 5/1996 | Ramesh | H01L 28/75 | 257/295 |
| 5,567,523 | A * | 10/1996 | Rosenblum | G11B 5/7368 | 428/408 |
| 5,589,845 | A * | 12/1996 | Yandrofski | H01P 7/084 | 343/753 |
| 5,601,748 | A * | 2/1997 | Mansour | C04B 35/47 | 501/137 |
| 5,863,661 | A * | 1/1999 | Sui | G11B 5/656 | 204/192.15 |
| 5,968,877 | A * | 10/1999 | Budai | H01L 39/2461 | 117/86 |
| 6,063,719 | A * | 5/2000 | Sengupta | C04B 35/2683 | 252/62.63 |
| 6,498,549 | B1 * | 12/2002 | Jiang | H01P 7/088 | 333/156 |
| 6,500,497 | B1 * | 12/2002 | Wang | B82Y 25/00 | 427/127 |
| 6,689,287 | B2 * | 2/2004 | Schubring | H01F 1/00 | 252/62.51 C |
| 6,833,173 | B1 * | 12/2004 | Nishikawa | G11B 5/7369 | 428/847.1 |

(Continued)

*Primary Examiner* — Kevin M Bernatz

(74) *Attorney, Agent, or Firm* — BainwoodHuang

(57) ABSTRACT

A monolithic multiferroic heterostructure fabricated using CSD (chemical solution deposition) is disclosed. The monolithic heterostructure includes a substrate, a ferromagnetic layer, a ferroelectric layer, and one or more seed layers that enhance crystallinity and promote high frequency performance.

8 Claims, 13 Drawing Sheets

(56) References Cited

U.S. PATENT DOCUMENTS

| | | | | |
|---|---|---|---|---|
| 7,105,866 | B2 * | 9/2006 | El-Zein | H01L 21/02488 257/104 |
| 7,169,619 | B2 * | 1/2007 | Liang | H01L 21/31604 257/E21.272 |
| 7,737,085 | B2 * | 6/2010 | Arendt | H01L 39/2461 505/238 |
| 8,124,254 | B2 * | 2/2012 | Zou | H01F 10/24 365/65 |
| 8,514,380 | B2 | 8/2013 | Zou et al. | |
| 9,142,870 | B2 * | 9/2015 | Harris | H01P 1/184 |
| 9,825,347 | B2 * | 11/2017 | Mills | H01P 3/12 |
| 10,190,045 | B2 | 1/2019 | Guo et al. | |
| 2006/0288928 | A1 * | 12/2006 | Eom | C30B 29/22 117/89 |
| 2020/0409190 | A1 * | 12/2020 | Demkov | C30B 23/063 |
| 2021/0249468 | A1 * | 8/2021 | Heron | H01L 41/47 |

* cited by examiner

COMPOSITION AND METHOD OF MAKING A MONOLITHIC HETEROSTRUCTURE OF MULTIFERROIC THIN FILMS

STATEMENT OF GOVERNMENTAL INTEREST

This invention is made with Government support, in whole or in part, under Army Research Office grants with Contract No. W911NF-13-C-0006 and Contract No. W911NF-11-C-0229. The government has certain rights in this invention.

BACKGROUND

1. Technical Field

The present disclosure relates to a monolithic multiferroic heterostructure that includes a ferromagnetic layer, a ferroelectric layer, and one or more seed layers. The present disclosure also relates to a chemical solution deposition (CSD) method to fabricate a monolithic multiferroic heterostructure.

2. Technical Background

Multiferroic materials combining two or more ferroic properties, especially ferroelectric and ferromagnetic properties, have attracted extensive attention in recent years due to their potential applications for electrically tuned ferromagnetic devices. Compared to conventional tunable microwave magnetic devices, which are tuned by magnetic fields, these electronically tunable microwave multiferroic devices can be much more energy efficient, less noisy, more compact, more lightweight, and faster.

However, the magneto-electric effects found in single-phase multiferroic materials are not usually large enough to be useful in practical applications. An alternative is to form multi-phase complexes, e.g., composites or multilayer structures in which each phase exhibits a strong ferroic property.

Previous processes for fabricating multiferroic heterostructures have employed pulsed laser deposition (PLD) and certain forms of chemical solution deposition (CSD).

SUMMARY

While monolithic thin film multiferroic heterostructures are promising in realizing electrically tunable, frequency agile microwave devices, challenges remain in simultaneously realizing growth of high-quality ferromagnetic and ferroelectric thin films with embedded electrodes and also close contact between these films to achieve sufficient electric field tunability of the magnetic response.

Unfortunately, neither PLD nor previous CSD approaches have been commercially attractive. PLD is known to produce high-quality crystals, but at high cost which is unsuitable for large scale production. Prior CSD approaches can be less expensive than PLD but tend to produce structures that suffer from high noise and poor high-frequency performance. What is needed, therefore, is a monolithic multiferroic heterostructure and technique for manufacturing the same, which is more economical than PLD and better-performing than prior CSD approaches.

To address this need at least in part, an improved technique uses CSD (chemical solution deposition) to produce a monolithic multiferroic heterostructure. The monolithic heterostructure includes a substrate, a ferromagnetic layer, a ferroelectric layer, and one or more seed layers that enhance crystallinity and promote high frequency performance. Advantageously, the seed layer enables a monolithic multiferroic heterostructure to manage high frequencies at performance levels comparable to PLD, while also using a CSD process which is both economical and scalable for commercial use.

Certain embodiments are directed to a monolithic multiferroic heterostructure that includes: a substrate; a buffer layer disposed above the substrate; a seed layer disposed above the buffer layer; a ferromagnetic (FM) layer disposed above and in direct contact with the seed layer; and a ferroelectric (FE) layer disposed above the FM layer.

Other embodiments are directed to a method of fabricating a monolithic multiferroic heterostructure. The method includes forming a plurality of layers on a substrate via multiple cycles of depositing, drying; firing, and cooling. The plurality of layers includes a seed layer, a ferromagnetic (FM) layer formed directly upon the seed layer, and a ferroelectric (FE) layer above the FM layer. Forming the seed layer includes depositing a seed precursor solution onto the substrate. Forming the FM layer includes depositing an FM precursor solution onto the substrate. The FM precursor solution and the seed precursor solution share a common set of ingredients.

The foregoing summary is presented for illustrative purposes to assist the reader in readily grasping example features presented herein; however, this summary is not intended to set forth required elements or to limit embodiments hereof in any way. One should appreciate that the above-described features can be combined in any manner that makes technological sense, and that all such combinations are intended to be disclosed herein, regardless of whether such combinations are identified explicitly or not.

BRIEF DESCRIPTION OF THE SEVERAL VIEWS OF THE DRAWINGS

The foregoing and other features and advantages will be apparent from the following description of particular embodiments, as illustrated in the accompanying drawings, in which like reference characters refer to the same or similar parts throughout the different views. The drawings are not necessarily to scale, emphasis instead being placed upon illustrating the principles of various embodiments.

DETAILED DESCRIPTION

Figure 1:
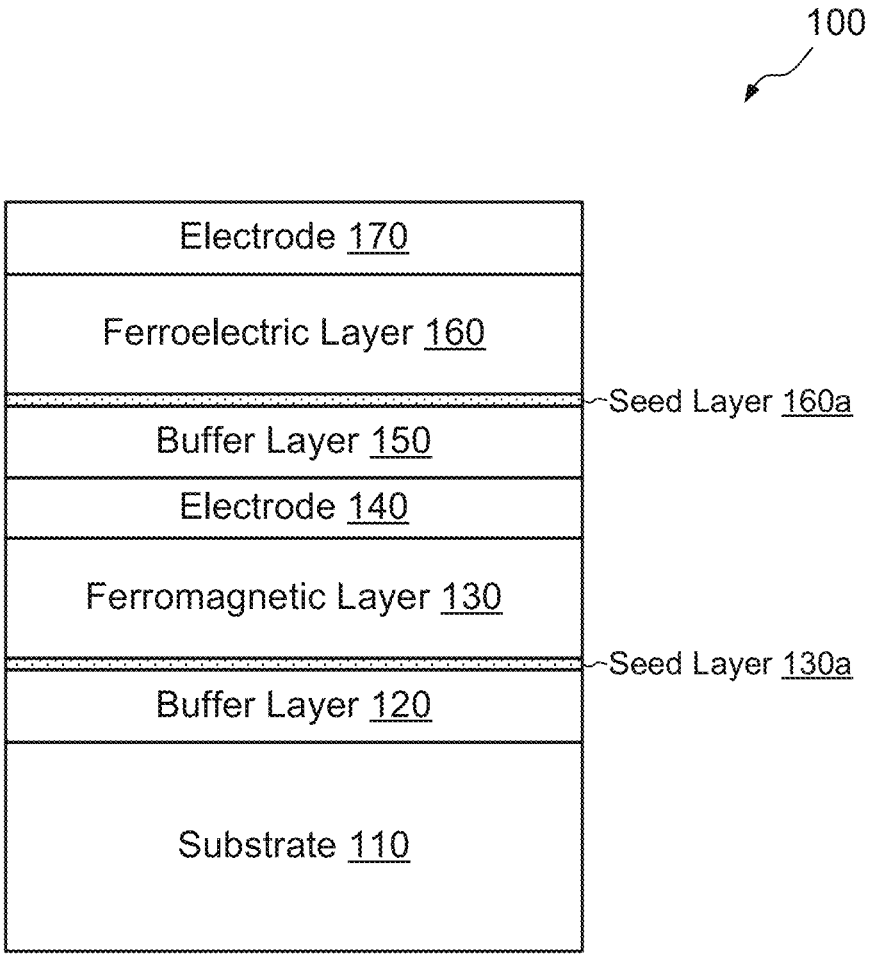
FIG. 1 is a schematic diagram illustrating an example multiferroic heterostructure in accordance with embodiments of the present invention.

Embodiments of the improved technique will now be described. One should appreciate that such embodiments are provided by way of example to illustrate certain features and principles but are not intended to be limiting.

An improved technique produces a monolithic multiferroic heterostructure using CSD (chemical solution deposition). The monolithic heterostructure includes a substrate, a ferromagnetic layer, a ferroelectric layer, and one or more seed layers that enhance crystallinity and promote high frequency performance.

Recent advances in processing complex oxide and multiferroic thin films present the opportunity for state-of-the-art components to be made from multiferroic thin film heterostructures. These technologies make it possible for fabricating electrically tuned ferromagnetic resonance devices with reduced bias fields, fast tuning speed, and reduced device size. The electric field tuning of ferromagnetic resonance (FMR) responses at millimeter-wave frequencies in monolithic magnetoelectric (ME) heterostructures has been demonstrated. The results have strong implications for the use of monolithic multiferroic heterostructures for electrically tunable devices.

In the ferroelectric-ferromagnetic heterostructures, ME coupling relies on the excitation of hybrid electromagnetic modes. An application of voltages across the ferroelectric component leads to a change in dielectric properties and results in a modification of the ferroelectric modes. This, in turn, can lead to a change in the dispersion of the hybrid ME modes and thereby a change in the magnetic response of the magnetic component. Thus, one can control the ferromagnetic response of a ME heterostructure with an electric field.

In order to achieve strong ME coupling at microwave frequencies with low loss, the magnetic materials in ME composites generally require large saturation magnetization values, high permeability, and narrow ferromagnetic resonance linewidth. M-type hexagonal ferrite (BaM) with a chemical formula $BaFe_{12}O_{19}$ is particularly attractive since it is magnetically self-biasing, which can reduce the need for heavy and expensive magnets for the design of ME devices. ME heterostructures having BaM layers have been extensively investigated and have shown great potential in realizing multiferroic composite based devices.

On the other hand, barium strontium titanate, $Ba_{1-x}Sr_xTiO_3$ (BST) is a very exciting class of microwave materials because its dielectric constant shows nonlinearity upon application of an electric field. This bias field dependent dielectric constant offers the possibility of making a wide variety of electrically tunable microwave devices. The advantages of using BST for tunable microwave applications are low loss, high tunability, and adjustable Curie temperature through the choice of chemical composition. It is expected that the most effective ME coupling will occur near the material's Curie temperature. The ability to control the dielectric properties of BST in a simple way allows device structures to be easily optimized for maximum tunability and minimum loss at the desired frequency and operating temperature. Extensive research on high quality BST film fabrication has indicated that films with nanograins and uniform particle size distributions exhibit the most desirable performance in electronic devices.

In our recent work at Boston Applied Technologies (BATi), we have developed monolithic thin film multiferroic heterostructures via a chemical solution deposition (CSD) route and have demonstrated an electrical field tunable isolator working at around 60 GHz. Such thin film monolithic multiferroic heterostructures include those containing BaM/BST multilayers with embedded electrodes. The electrical field tunability allows devices to achieve faster speed as well as minimal associated losses and noise. These advanced devices will have great applications in wireless communications, radars, defense, and aerospace- or ground-based satellite control systems.

BATi has become a pioneer in the development and application of CSD for fabrication of high-quality complex oxide films. CSD is a simple, flexible, and cost effective growth technique with the capability of growing thin films over large areas. BATi has also computerized the CSD process, allowing quality controlled films to be fabricated via nano-engineering in a layer-by-layer coating process. Our CSD apparatus is capable of multiple cycles that include immersing, withdrawing, drying, annealing and cooling stages. The number of cycles, the number of stages in a cycle and the processing parameters of each stage can all be controlled automatically. This allows a layer-by-layer control of the coatings at the nanometer scale. The computerized, layer-by-layer CSD process is capable of achieving a dense coating while avoiding large voids in the film, which are often observed in the typical CSD process with polymer additions and thick single layer coatings.

Our CSD method has also shown advantages in composition and structural control. As a result, BST, PZT and BaM thin films have been texturally grown on appropriate substrates by the CSD method, showing crystalline quality nearly equal to that produced by PLD. In the case of multi-component coatings, problems with vapor phase deposition methods are substantially reduced or eliminated in the CSD process.

In order to achieve low microwave loss, high device stability and reproducibility, thin films with minimum defects are desirable. It is especially desirable to provide low defect interfaces. To this end, we have developed buffer layers as adhesion promoter and diffusion barrier to accelerate the formation of an epitaxial film. The buffer layers are preferably compatible with the films and substrates, both structurally and thermally.

Microwave losses critically depend on the materials quality and thin film interface properties. A key issue in the processing low loss films is the interface engineering. In the current disclosure, interfaces between films and substrates are engineered through developing nano-seeds and buffer layers. The seed materials can be BaM, BST or MgO, $Al_2O_3$, etc. The nano-seeds form seed layers through adjusting the concentration, viscosity and wettability of precursor solutions onto substrates.

Although sapphire substrates are very handy and steadily available with reasonable price, processing such substrates can be difficult and costly. Polycrystalline alumina substrates are redeemed as a promising alternative in the microwave application. Polycrystalline alumina substrates can provide minimum structural and thermal expansion mismatch between the thin film materials and substrates. In the disclosed embodiments, with proper seed layers and buffer layer material developed, we successfully grow high quality BST/BaM thin film heterostructures on polycrystalline alumina substrates.

FIG. 1 shows an example monolithic multiferroic heterostructure 100 in accordance with an embodiment of the invention. The heterostructure 100 includes, from bottom to top, a substrate 110, a first buffer layer 120 on the substrate 110, a first seed layer 130*a*, a ferromagnetic layer 130, a first electrode layer 140, a second buffer layer 150, a second seed layer 160*a*, a ferroelectric layer 160, and a second electrode layer 170. Some embodiments may include only a single seed layer, 130*a* or 160*a*. Likewise, some embodiments may include only a single buffer layer, 120 or 150.

Figure 2:
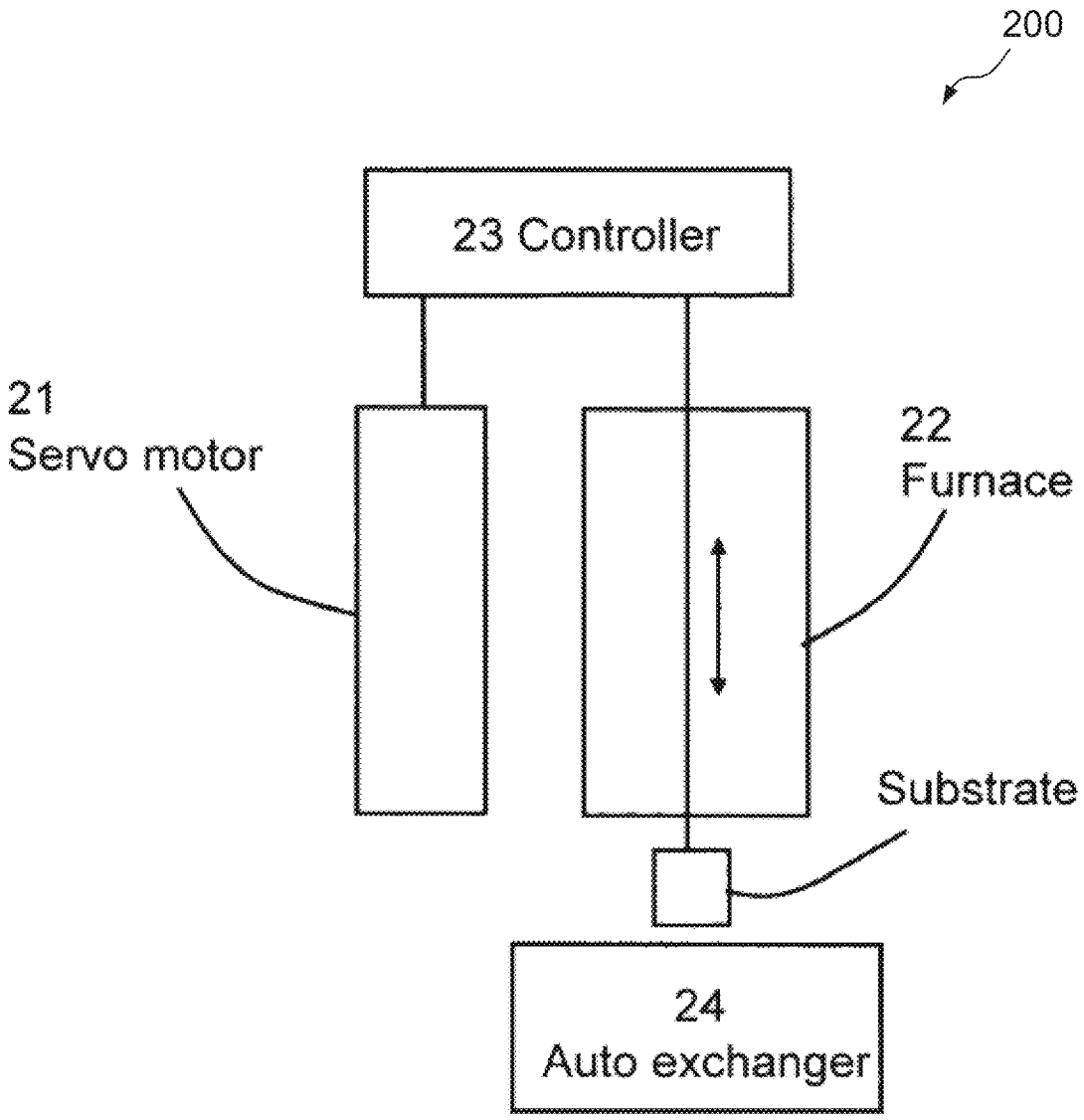
FIG. 2 is a schematic illustration of an example solution coating apparatus used for fabricating the multiferroic heterostructure of FIG. 1.

The films may be fabricated using a CSD method. FIG. 2 shows an example coating apparatus 200 used for controlling CSD fabrication. As shown, the coating apparatus 200 includes three major parts: a driving mechanism 21, a vertical tube furnace 22, and a computerized controller 23. The apparatus 200 is capable of multiple cycles, which may include immersing, withdrawing, drying, annealing, and cooling stages. The number of cycles, the number of stages in a cycle, and the motion and/or duration of each stage can all be programmed into the controller 23. The coating apparatus 200 is also equipped with an automated exchanger 24 for providing solutions of different precursors. A unique advantage of the coating apparatus 200 is that it can be used to grow multilayer (or superlattice) materials conveniently by dipping the substrate 110 into different chemical precursors each time.

To coat one or more layers onto the substrate 110 of the heterostructure 100, solutions of individual metal-organic compounds are mixed at desired cation ratios to form a coating solution, also referred to herein as a "precursor solution." This coating solution is deposited on the substrate 110, either directly or over one or more previously applied layers, by dip-coating to produce a wet film. Spin coating and/or spray coating may also be used for depositing the coating solution. The wet film is then heated to remove any solvent that did not evaporate during deposition and to decompose the metal-organic compounds to produce an inorganic film. For most applications, a primary consideration for an adequate film forming process is the ability to produce a final crack-free film. Solution-derived films tend to form cracks with increasing thickness, owing to the high volume shrinkage as organic materials are removed during the firing process. This is especially true for films requiring high-temperature treatment for crystallization. Not only is there volume shrinkage accompanying the amorphous-to-crystalline transformation, but also factors like thermal expansion mismatch between the film and the substrate become more severe as the processing temperature increases.

Figure 3:
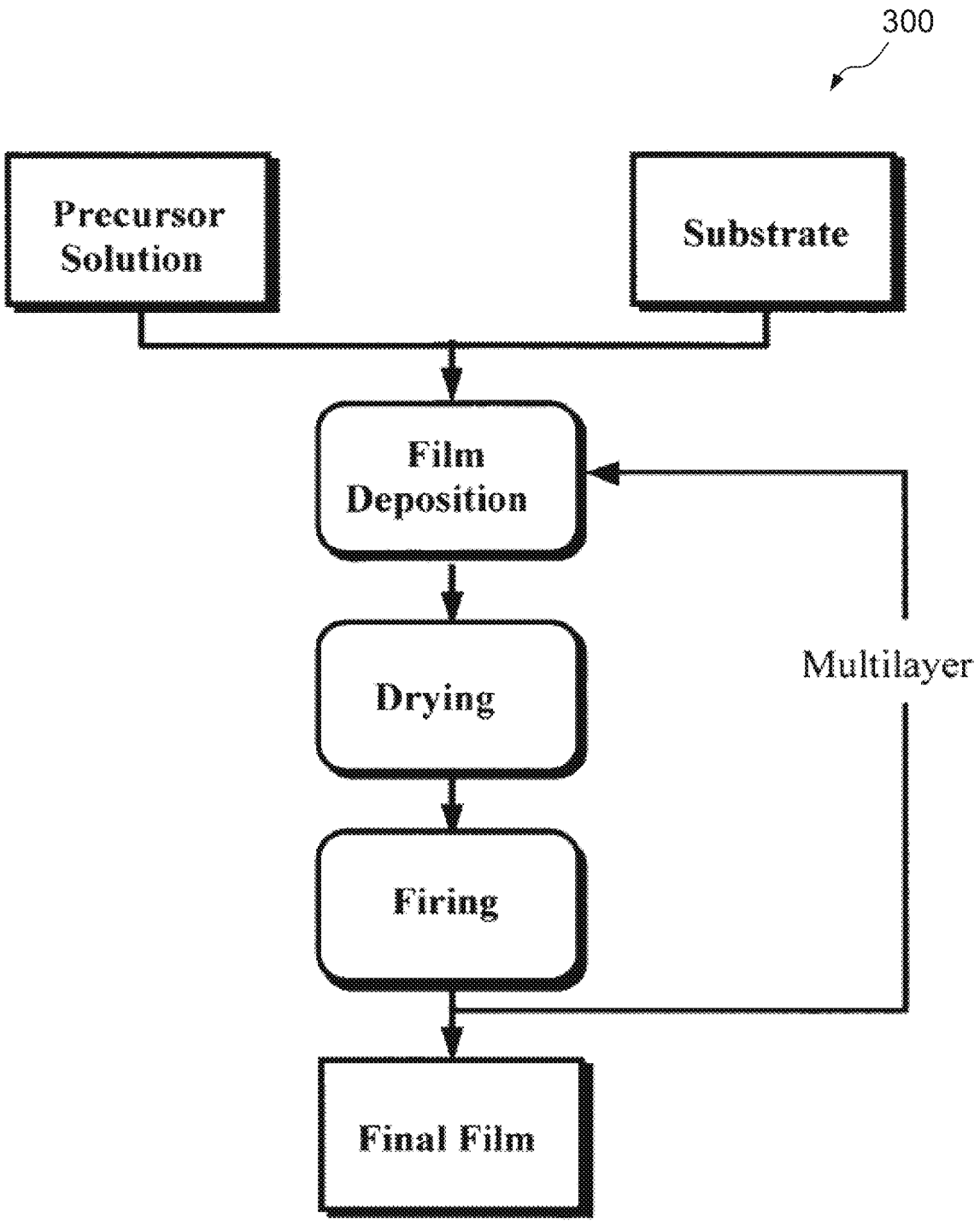
FIG. 3 is a flow chart showing an example process of manufacturing thin films in the multiferroic hetero structure of FIG. 1.

FIG. 3 shows an example method 300 for preparing crystalline films from solutions by multiple dipping steps. The temperature cycling nature of the solution coating process (by repeated heating and cooling for each layer) significantly reduces the stress due to thermal expansion mismatch between the substrate and film materials.

In some embodiments, c-sapphire is used as substrate 110. In other embodiments, polycrystalline alumina is used as substrate 110. Silicon or silicon carbide can also be used as substrate 110.

Buffer layers 120 and 150 are incorporated to facilitate the formation of crystalline heterostructures and/or highly textured microstructures. An appropriate buffer layer can also help to protect the substrate 110 at high deposition temperature and/or improve the substrate/film interfaces. In some examples, oxide materials, such as but not limited to MgO, $SrRuO_3$, $PbTiO_3$, $Al_2O_3$ and $CeO_2$, are used as buffer layers 120 and/or 150.

In some embodiments, the ferromagnetic thin film layer 130 is barium hexaferrite ($BaFe_{12}O_{19}$, or BaM). It can also be M-type strontium hexaferrite ($SrFe_{12}O_{19}$, or SrM) or Sc-substituted BaM. Some metal elements, such as, but not limited to, Sc, Ga, Al, Zn, can be incorporated into the BaM. Other ferromagnetic materials, such as but not limited to $CoFe_2O_4$ (CFO) or $NiZn_2O_4$ (NZO), or $Y_3Fe_5O_{12}$ (YIG), may also be used as the ferromagnetic thin film layer 130.

To fabricate ferromagnetic (FM) BaM thin films 130, an FM precursor solution for preparing the BaM films may be obtained by dissolving barium nitrate and iron nitrate in water and ethylene glycol. Then 2-methoxyethanol and methanol may be used to adjust the viscosity; wherein concentrations of the solutions are between 0.01 and 0.4 M (mol/L), for example.

The on site heating temperature used to crystallize the BaM film 130 is in the range of 600-900° C. The dipping speed is 1-10 mm/second. The firing times are between 1-5 minutes. The firing speed is about 1-10 mm/second. These are suitable examples but are not intended to be limiting.

It is found that an oxygen atmosphere is critical to the crystallization of the BaM films 130, and a seed layer 130*a* is favorable to enhancing the crystallinity of the BaM films. The seed layer 130*a* can be obtained by altering the concentration of the precursor solution or the heat treatment temperature of a BaM layer 130. In one embodiment, the precursor solution of the BaM seed layer 130*a* is made by 10 times diluted BaM precursor, i.e., a diluted version of the same precursor that is used when forming the BaM (FM) layer 130. In general, the precursor solutions used to form the FM layer 130 and its seed layer 130*a* share a common set of ingredients. Indeed, they may in some examples include the same ingredients, but with different concentrations, viscosities, and/or heat treatments.

In some embodiments, the ferroelectric thin film layer 160 is barium strontium titanate (BST). Other ferroelectric materials, such as but not limited to lead zirconate titanate (PZT) or lead magnesium niobium titanate (PMNPT), may also be used as the ferroelectric thin film layer 160.

Figure 4:
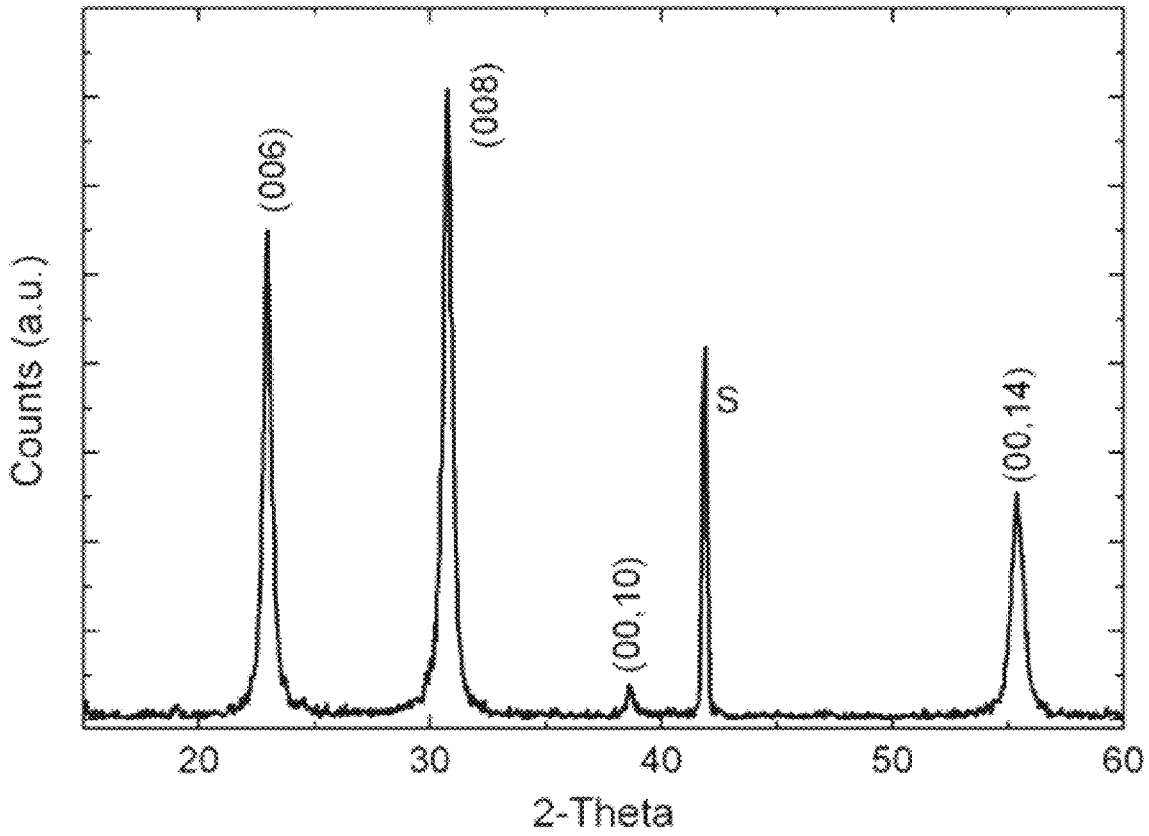
FIG. 4 is a graph showing an XRD spectrum of an example highly textured BaM thin film coated on C-sapphire substrate.
Figure 5:
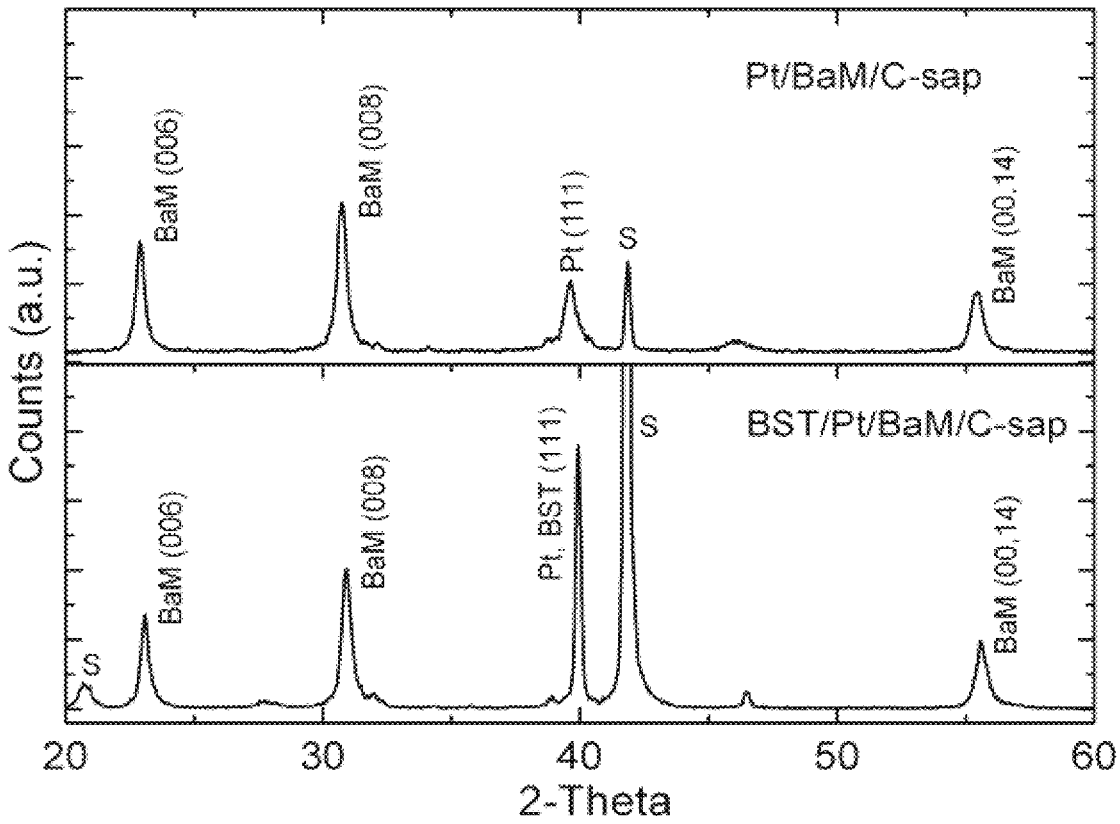
FIG. 5 is a graph showing an XRD spectrum of an example multiferroic heterostructure film comprising of BST/Pt/BAM coated on C-sapphire substrate, both before (top) and after (bottom) coating with BST film.
Figure 6:
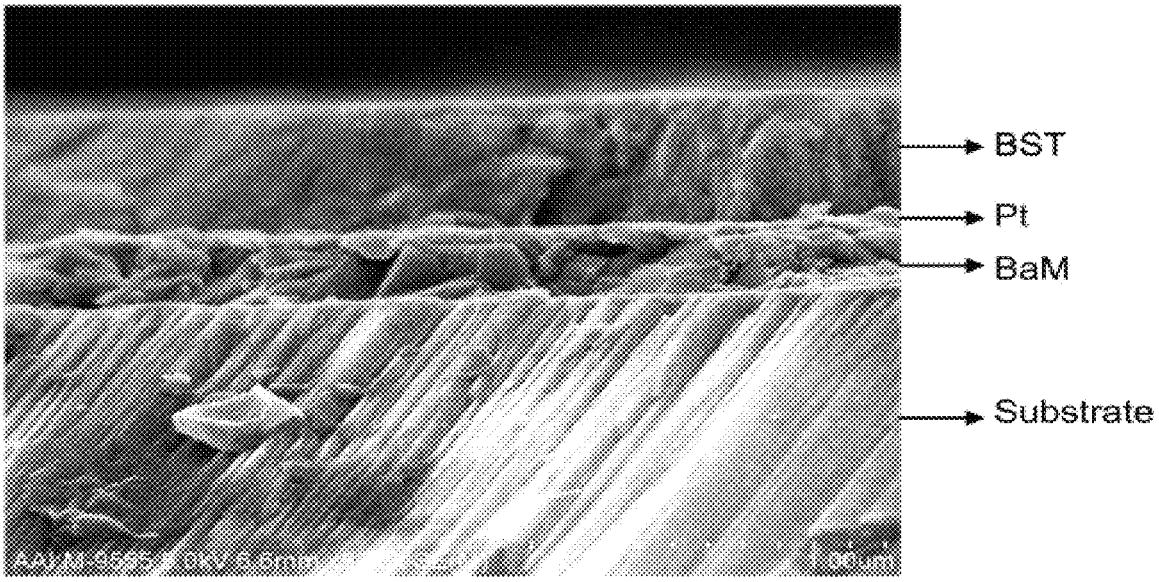
FIG. 6 is a cross-sectional Scanning Electron Microscope (SEM) image of an example multiferroic heterostructure film that includes BaM/Pt/BST coated on C-sapphire substrate.

In some embodiments, a multiferroic heterostructure is fabricated on a c-sapphire substrate. The ferromagnetic M-type barium hexaferrite ($BaFe_{12}O_{19}$, or BaM) thin film layer is coated on c-sapphire, with an out-of-plan (OOl) orientation, as shown in FIG. 4. Then platinum (Pt) electrode is sputtered on the highly textured BaM layer, which is also highly oriented, as shown in FIG. 5. Continuously, highly textured BST layer is coated on the said platinum layer. A typical XRD spectrum of a multiferroic heterostructure film comprising of BST/Pt/BAM coated on a c-sapphire is shown in FIG. 5. Shown in FIG. 6 is a cross-sectional SEM image of a multiferroic hetero structure film including BST/Pt/BAM coated on c-sapphire.

Figure 7:
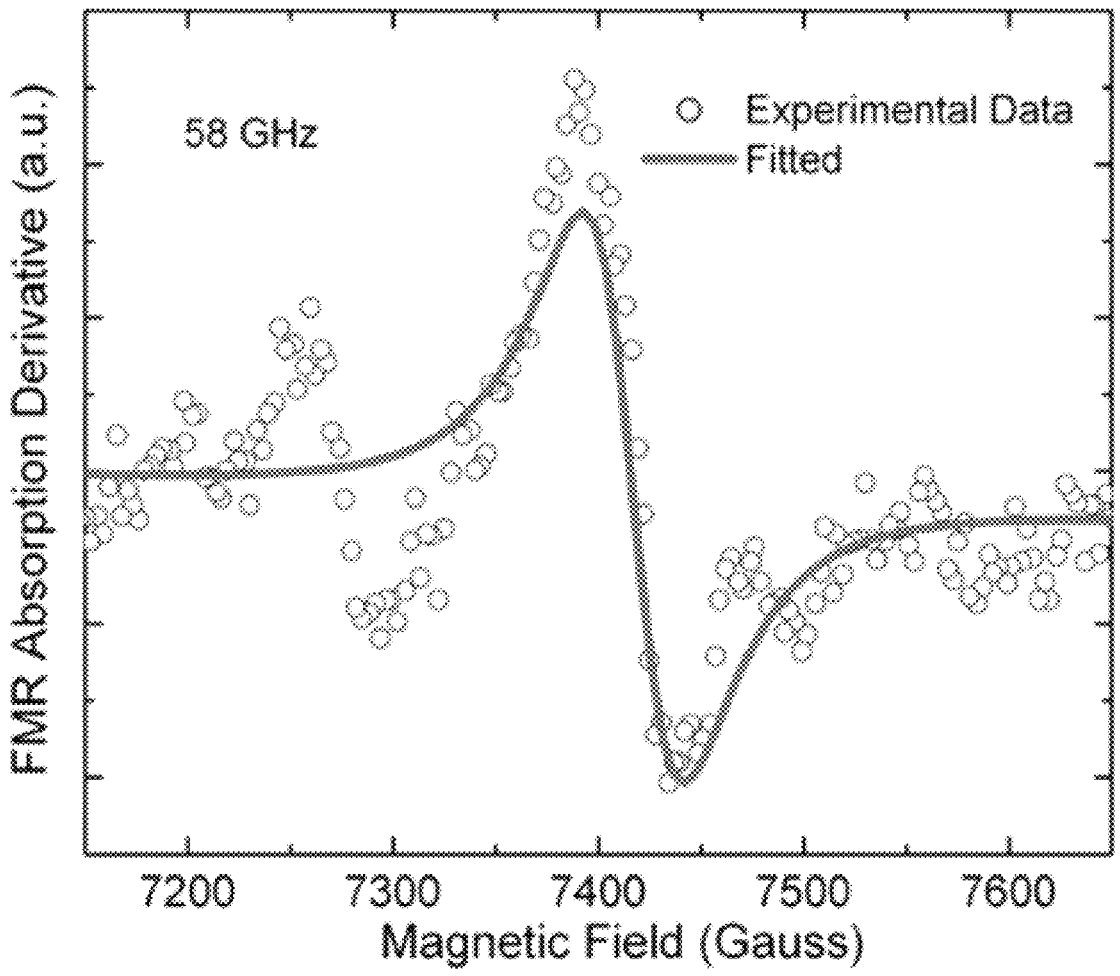
FIG. 7 is a graph showing an FMR profile of an example BaM thin film coated on C-sapphire substrate.
Figure 8:
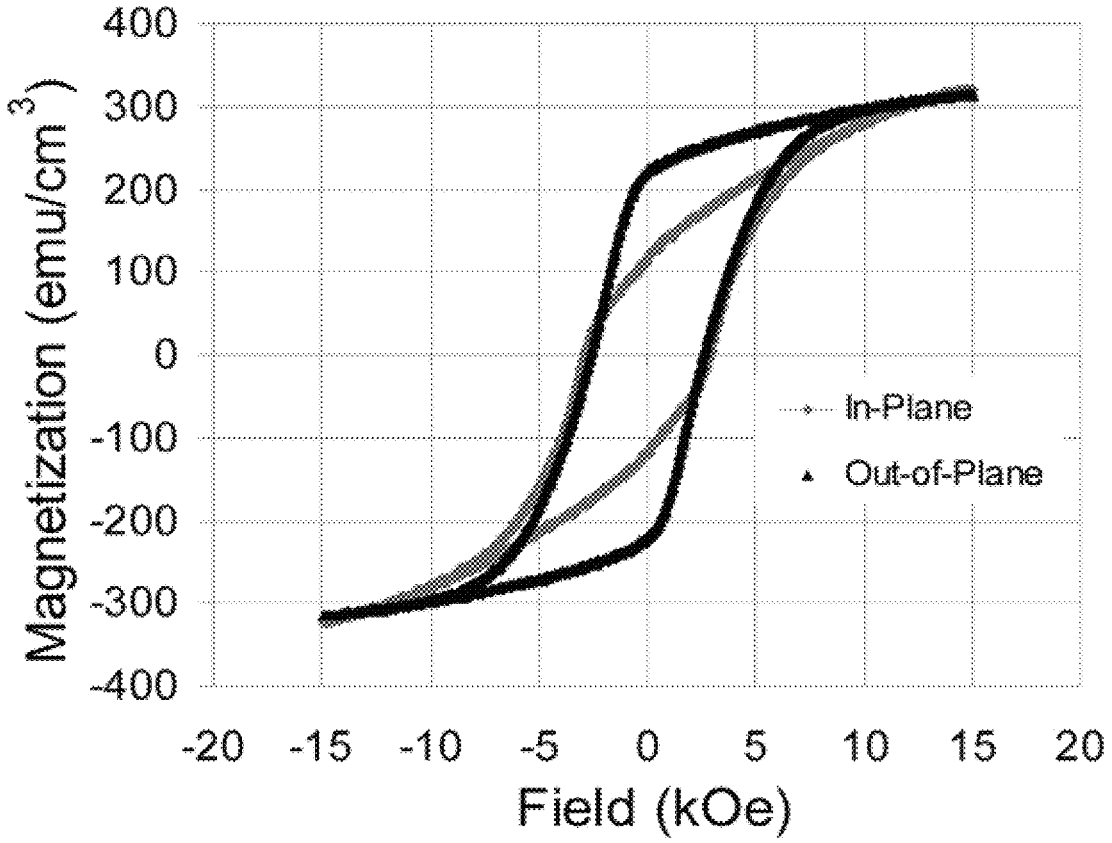
FIG. 8 is a graph showing hysteresis loops of an example BaM thin film coated on c-sapphire substrate.

The introduction of seed layer 130*a* results in preferred performance of the BaM coatings, i.e., narrow ferromagnetic resonance (FMR) linewidths, comparable to those made by PLD. FIG. 7 is a typical FMR profile of the BaM thin film 130 showing a narrow linewidth. FIG. 8 is showing typical hysteresis loops of a BaM thin film 130 coated on c-sapphire.

Various compositions of buffer layers 120 and/or 150 (e.g., MgO, $Al_2O_3$ and $CeO_2$) are examined for improving the interface quality of BST and BaM films through reducing the structural mismatch of the film materials and substrates. It is found that MgO buffer layers enhance thin film density of a BaM film coated on c-sapphire substrate and SiC substrate, and also increase the anisotropy and "squareness" (higher saturation remanence to the maximum magnetization ratio).

Figure 9:
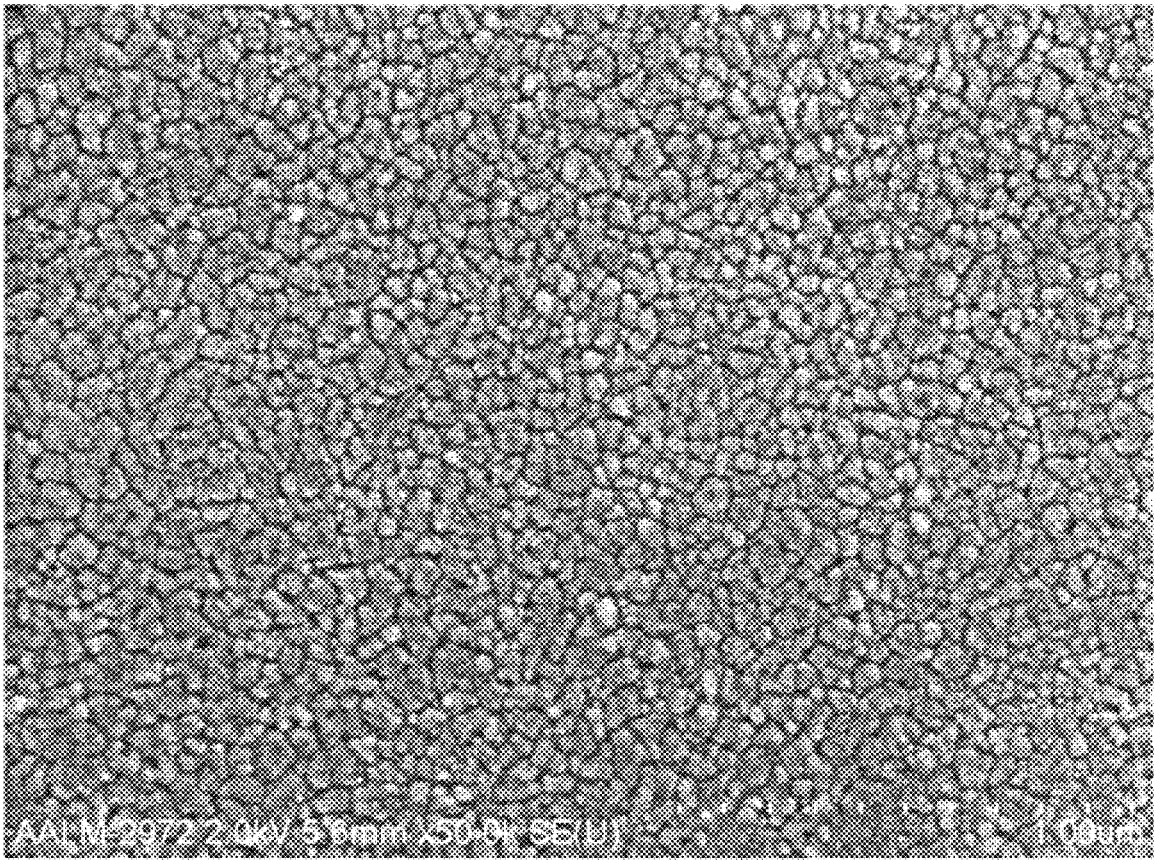
FIG. 9 is a SEM image of an example BST(60/40) thin film surface coated on BaM/c-sapphire using MgO as a buffer layer.

FIG. 9 shows an SEM image of a BST(60/40) thin film surface coated on BaM/c-sapphire using MgO as buffer layer, which improves the smoothness of the surface. $CeO_2$ buffer layers dramatically improve the crystallization behaviors of the BaM films coated on Si, a-sapphire and r-sapphire substrates, owing to the lattice constant of $CeO_2$ being between those of BaM and the Si, a-sapphire and r-sapphire substrates.

For ferroelectric (FE) BST films 160, the FE precursor solution is prepared by dissolving stoichiometric amounts of barium, strontium acetates and titanium diisopropoxidebis (acetylacetonate) in acetic acid. Ethylene glycol and methanol then are used to adjust the viscosity. Concentrations of the solutions are between 0.01 and 0.4 M (mol/L), for example.

For MgO buffer layers, magnesium acetate is dissolved in 2-methoxyethanol and methanol with addition of acetic acid. Concentrations of the solutions are between 0.01 and 0.4 M (mol/L), for example.

The top electrode layer 170 can be Au, Pt, Ni, Cu or their combinations. Metal oxides, such as, but not limited to, $LaNiO_3$, $SrRuO_3$, can also be used as electrode 170.

Figure 10:
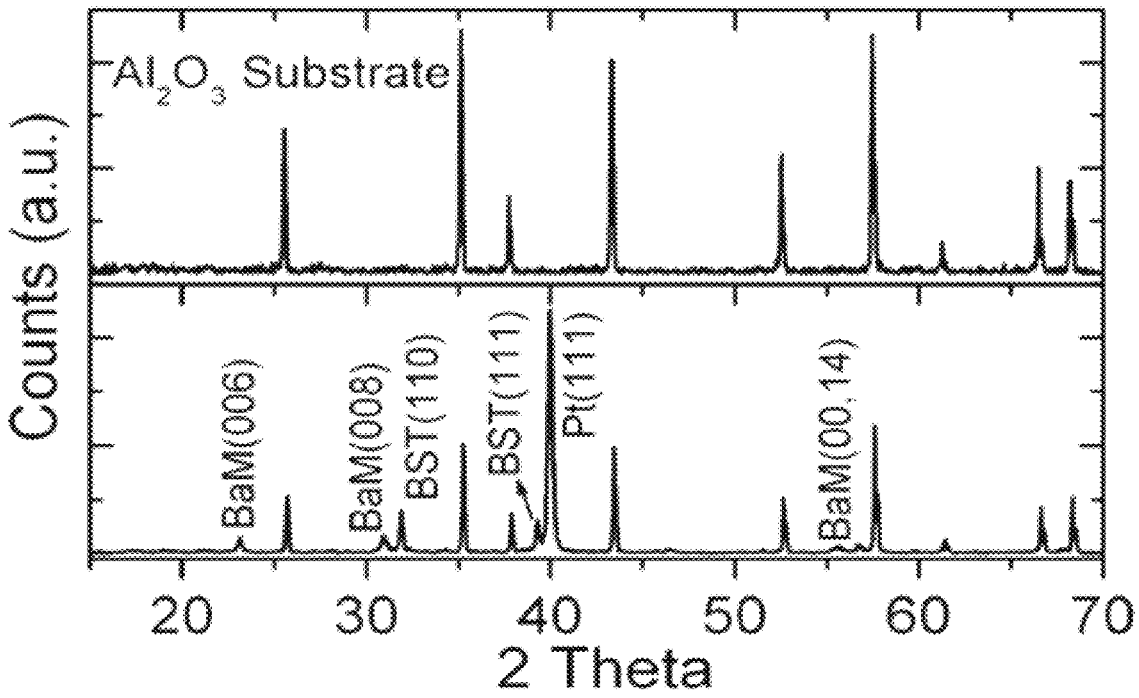
FIG. 10 is a graph showing XRD patterns of an example polycrystalline alumina substrate (top) and an example multiferroic heterostructure including BST(60/40)/Pt/BaM coated on a polycrystalline alumina substrate with an amorphous aluminum oxide buffer layer.

In some embodiments, the multiferroic heterostructure 100 is fabricated on a polycrystalline alumina ($Al_2O_3$) substrate 110. FIG. 10 shows XRD patterns of the polycrystalline alumina substrate (top) and a multiferroic heterostructure comprising of BST(60/40)/Pt/BaM coated on the polycrystalline alumina substrate (bottom) with an amorphous aluminum oxide buffer layer 120. The XRD patterns indicate pure phase and good crystallization of the films with preferred orientation, which leads to preferred performance.

The buffer precursor solution used to prepare the non-crystalline alumina buffer layer 120 is made by dissolving aluminum nitrates in 2,4-Pentanedione and ethanol; the concentration of the precursor solution is 0.05-0.5 M. The processing temperature of the buffer layer 120 is between 400 to 700° C. The thickness of the buffer layer 120 is between 30-300 microns. Again, these are merely examples.

Figure 11:
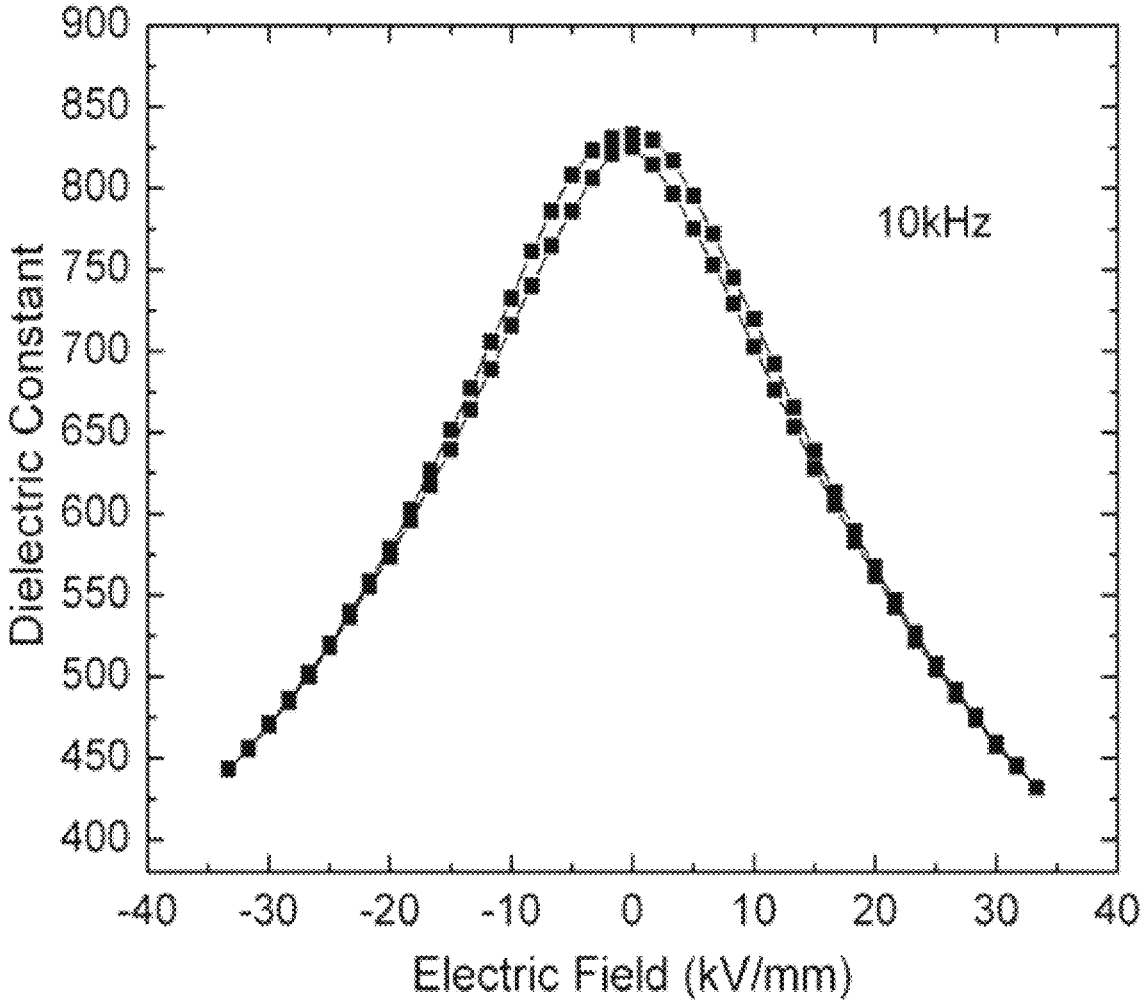
FIG. 11 is a graph showing a dielectric constant curve of an example BST/Pt/BaM heterostructure coated on a polycrystalline alumina substrate.
Figure 12:
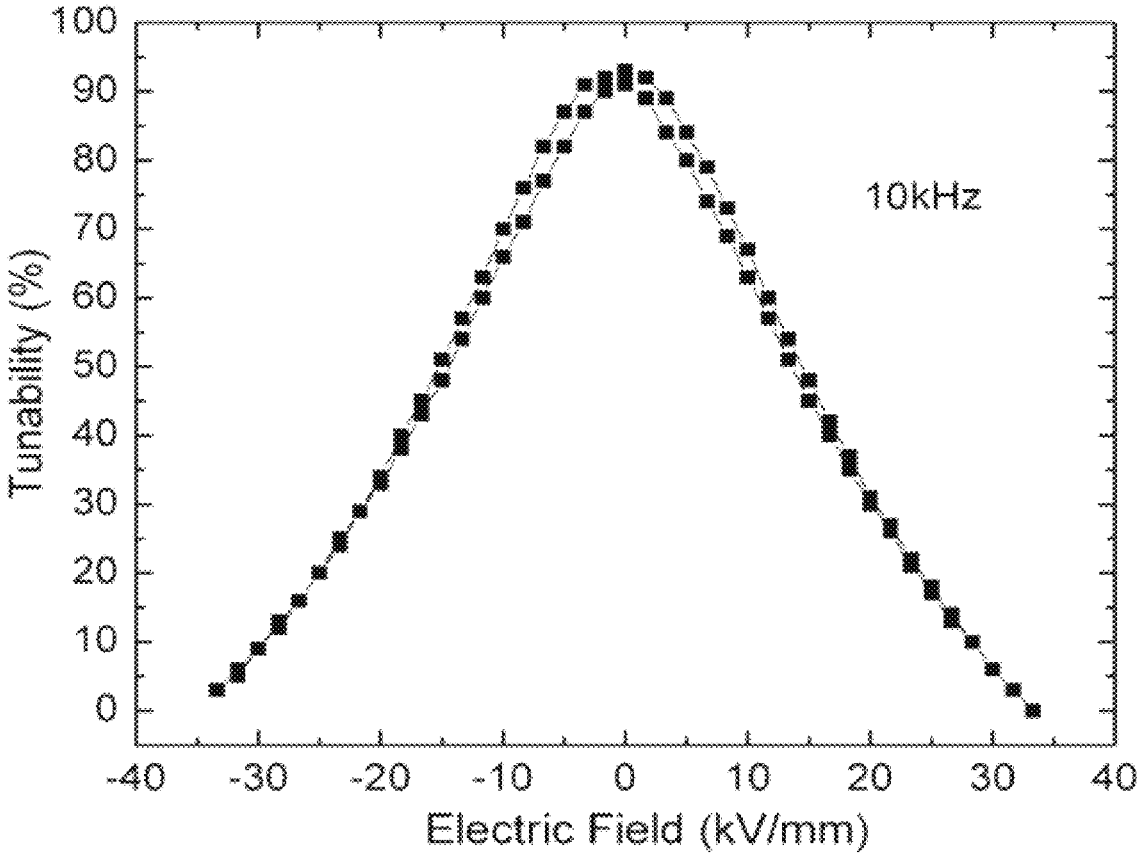
FIG. 12 is a graph showing a tunability curve of an example BST/Pt/BaM heterostructure coated on a polycrystalline alumina substrate.
Figure 13:
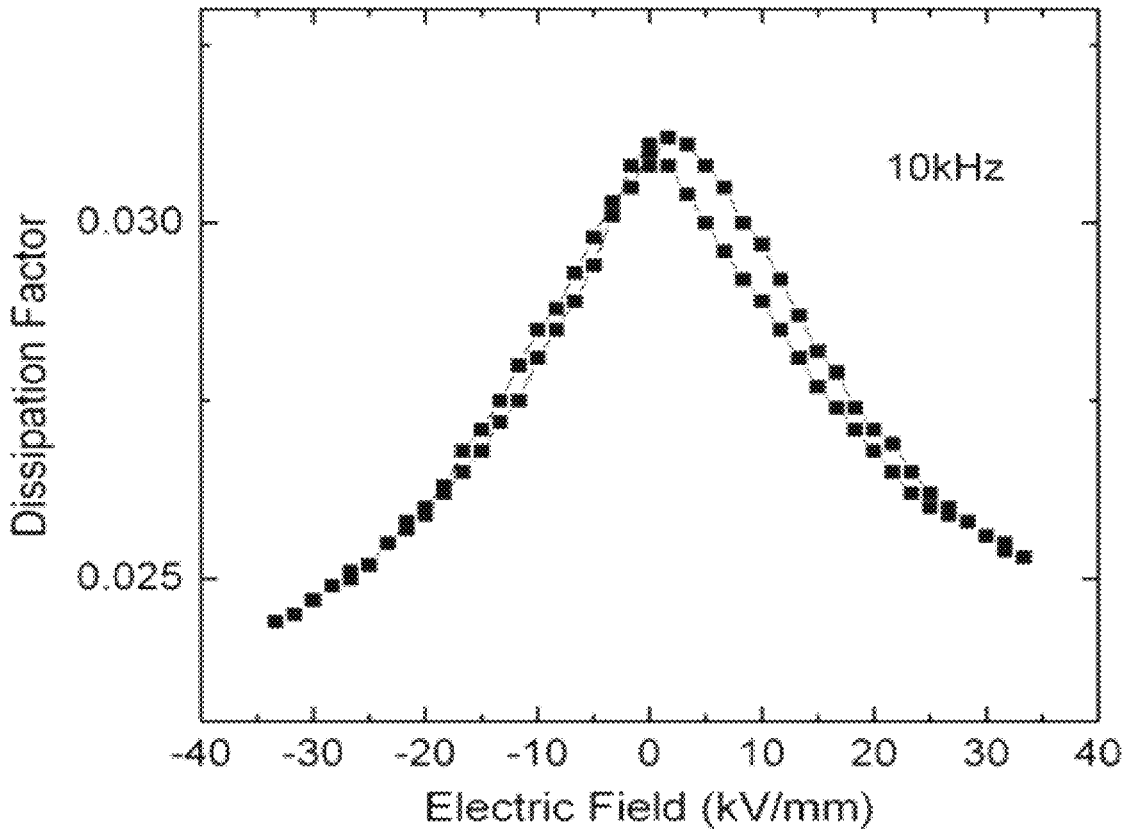
FIG. 13 is a graph showing a dissipation curve of an example BST/Pt/BaM heterostructure coated on a polycrystalline alumina substrate.

Shown in FIG. 11 is a typical curve of dielectric constant versus electric field of the multiferroic heterostructure film comprising of BST(60/40)/Pt/BaM coated on an alumina substrate. Shown in FIG. 12 is a typical curve of tunability versus electric field of the multiferroic heterostructure film comprising of BST(60/40)/Pt/BaM coated on an alumina substrate. Shown in FIG. 13 is a typical curve of dissipation factor versus electric field of the multiferroic heterostructure film comprising of BST(60/40)/Pt/BaM coated on an alumina substrate. Together, FIGS. 11-13 show excellent ferroelectric effects and a high quality of the heterostructure/BST film.

A method of fabricating a monolithic heterostructure of multiferroic thin films has been disclosed. High quality ferroelectric/ferromagnetic thin film heterostructures are produced via a low cost CSD (chemical solution deposition) method. Highly textured BaM thin films coated on c-sapphire or polycrystalline alumina are demonstrated with narrow FMR linewidths. Then BST thin films of nano-grains with uniform grain size distributions are coated on the BaM thin films with bottom electrodes and appropriate buffer layers to form a monolithic BST/Pt/BaM heterostructure, which has the potential to be used in the electrical tunable devices. The disclosed multiferroic thin film heterostructures are measured with high permittivity, high tunability, high breakdown strength and relatively low loss.

In one aspect, a multiferroic heterostructure has been described comprising of a ferromagnetic layer, a ferroelectric layer, with electrodes and appropriate buffer layers.

In another aspect, a CSD method has been described for use in fabricating the said ferromagnetic thin film, e.g., BaM thin films with a unique precursor solution.

In another aspect, a seed layer has been described to facilitate the fabrication of the BaM thin films. Introducing the seed layer also improves the interfaces, resulting in preferred performances, e.g., narrow ferromagnetic resonance (FMR) linewidths, comparable to those made by PLD.

In another aspect, a buffer layer has been described to coat BaM thin films on polycrystalline alumina substrate. The said buffer layer is made of a non-crystalline aluminum oxide thin film and is located between the polycrystalline alumina substrate and the BaM thin film.

In yet another aspect, a CSD method has been described to fabricate the said ferroelectric thin film, i.e., BST thin films coated on top of Pt/BaM, which is coated on c-sapphire or polycrystalline alumina, with high permittivity, large tunability, high breakdown strength and relatively low loss.

Although particular embodiments of the invention have been described and illustrated herein, it is recognized that modifications and variations may readily occur to those skilled in the art. For example, other film fabrication technologies can be used to make the structure, or different precursors can be used in a solution coating method. The thickness of any layer can be changed. To enhance the ferromagnetic and ferroelectric effects of the individual layer, periodic multilayer structures can be further incorporated into the heterostructure multiferroic film.

As used throughout this document, the words "comprising," "including," "containing," and "having" are intended to set forth certain items, steps, elements, or aspects of something in an open-ended fashion. Also, as used herein and unless a specific statement is made to the contrary, the word "set" means one or more of something. This is the case regardless of whether the phrase "set of" is followed by a singular or plural object and regardless of whether it is conjugated with a singular or plural verb. Also, a "set of" elements can describe fewer than all elements present. Thus, there may be additional elements of the same kind that are not part of the set. Further, ordinal expressions, such as "first," "second," "third," and so on, may be used as adjectives herein for identification purposes. Unless specifically indicated, these ordinal expressions are not intended to imply any ordering or sequence. Thus, for example, a "second" event may take place before or after a "first event," or even if no first event ever occurs. In addition, an identification herein of a particular element, feature, or act as being a "first" such element, feature, or act should not be construed as requiring that there must also be a "second" or other such element, feature or act. Rather, the "first" item may be the only one. Also, and unless specifically stated to the contrary, "based on" is intended to be nonexclusive. Thus, "based on" should not be interpreted as meaning "based exclusively on" but rather "based at least in part on" unless specifically indicated otherwise. Although certain embodiments are disclosed herein, it is understood that these are provided by way of example only and should not be construed as limiting.

Those skilled in the art will therefore understand that various changes in form and detail may be made to the embodiments disclosed herein without departing from the scope of the following claims.

What is claimed is:

1. A monolithic multiferroic heterostructure, comprising:

a substrate;

a buffer layer disposed above the substrate;

a seed layer disposed above the buffer layer;

a ferromagnetic (FM) layer disposed above and in direct contact with the seed layer;

a ferroelectric (FE) layer disposed above the FM layer;

a first electrode disposed between the FM layer and the FE layer; and a second electrode disposed above the FE layer, wherein the substrate is composed at least in part of polycrystalline alumina, wherein the buffer layer is composed at least in part of amorphous aluminum oxide, and wherein the FM layer and the seed layer each include one or more of BaM (M-type barium hexaferrite, $BaFe_{12}O_{19}$), SrM (M-type strontium hexaferrite, $SrFe_{12}O_{19}$), scandium-substituted BaM, gallium-substituted BaM, aluminum-substituted BaM, and cesium-substituted BaM.

2. The monolithic multiferroic heterostructure of claim 1, wherein the first electrode and the second electrode are at least partially composed of platinum, gold, nickel, copper, $LaNiO_3$ and/or $SrRuO_3$.

3. The monolithic multiferroic heterostructure of claim 2, wherein the substrate is composed at least in part of polycrystalline alumina, silicon, silicon carbide, and/or sapphire.

4. The monolithic multiferroic heterostructure of claim 1, wherein the FE layer is at least partially composed of at least one of:

BST (barium strontium titanate; $Ba_{1-x}Sr_xTiO_3$);

alternative forms of BST that include, in place of barium, at least one of lead, manganese, magnesium, and/or calcium;

PZT (lead zirconate titanate); or

PMNPT (lead magnesium niobium titanate).

5. The monolithic multiferroic heterostructure of claim 1, wherein the FE layer is at least partially composed of BST (barium strontium titanate), and wherein the monolithic multiferroic heterostructure further comprises a second seed layer disposed below and in direct contact with the FE layer.

6. The monolithic multiferroic heterostructure of claim 5, further comprising a second buffer layer disposed between the first electrode and the FE layer.

7. A monolithic multiferroic heterostructure, comprising:

a substrate;

a buffer layer disposed above the substrate;

a seed layer disposed above the buffer layer;

a ferromagnetic (FM) layer disposed above and in direct contact with the seed layer;

a ferroelectric (FE) layer disposed above the FM layer;

a first electrode disposed between the FM layer and the FE layer; and a second electrode disposed above the FE layer, wherein the first electrode and the second electrode are at least partially composed of platinum, gold, nickel, copper, $LaNiO_3$ and/or $SrRuO_3$, wherein the substrate is composed at least in part of polycrystalline alumina, wherein the buffer layer is composed at least in part of amorphous aluminum oxide, wherein the seed layer is composed at least in part of BaM (M-type barium hexaferrite; $BaFe_{12}O_{19}$), and wherein the FM layer is composed at least in part of BaM (M-type barium hexaferrite; $BaFe_{12}O_{19}$).

8. A monolithic multiferroic heterostructure, comprising:

a substrate;

a buffer layer disposed above the substrate;

a seed layer disposed above the buffer layer;

a ferromagnetic (FM) layer disposed above and in direct contact with the seed layer; and a ferroelectric (FE) layer disposed above the FM layer;

wherein the buffer layer is composed at least in part of amorphous aluminum oxide, wherein the seed layer is composed at least in part of BaM (M-type barium hexaferrite; $BaFe_{12}O_{19}$), and wherein the FM layer is composed at least in part of BaM (M-type barium hexaferrite; $BaFe_{12}O_{19}$).

* * * * *